US006253408B1

(12) United States Patent
Feld et al.

(10) Patent No.: US 6,253,408 B1
(45) Date of Patent: Jul. 3, 2001

(54) MOP

(75) Inventors: Uwe Feld, Graben; Michaela Gerstenlauer, Augsburg; Klaus Huber, Kaufering; Klaus Peter Meier, Kelkheim; Richard Schilling, Rimbach; Hans-Jürgen Wendelken, Sinsheim, all of (DE)

(73) Assignee: Firma Carl Fraudenberg, Weinheim (DE)

( * ) Notice: Subject to any disclaimer, the term of this patent is extended or adjusted under 35 U.S.C. 154(b) by 0 days.

(21) Appl. No.: 09/352,728

(22) Filed: Jul. 13, 1999

(30) Foreign Application Priority Data

Jul. 24, 1998 (DE) ..... 198 33 553

(51) Int. Cl.[7] ..... A47L 13/20
(52) U.S. Cl. ..... 15/229.2; 15/118
(58) Field of Search ..... 15/118, 228, 229.1, 15/229.2, 229.6

(56) References Cited

U.S. PATENT DOCUMENTS

| | | | | |
|---|---|---|---|---|
| 1,408,488 | * | 3/1922 | Toplitz | 15/229.2 |
| 4,530,130 | * | 7/1985 | Moss | 15/229.2 |
| 5,279,015 | * | 1/1994 | Meiring | 15/229.2 |
| 5,577,290 | * | 11/1996 | Monahan | 15/118 |
| 5,875,509 | * | 3/1999 | Facca | 15/118 |
| 5,996,161 | * | 12/1999 | Facca | 15/118 |

FOREIGN PATENT DOCUMENTS

| | | |
|---|---|---|
| 76 25 260 | 12/1976 | (DE) . |
| 76 25 250 | 6/1977 | (DE) . |

* cited by examiner

*Primary Examiner*—Terrence R. Till
(74) *Attorney, Agent, or Firm*—Kenyon & Kenyon

(57) ABSTRACT

A mop to be fastened at the end of a mop handle, including a holding device to which a number of relatively mobile, absorbent strips made of a textile material are fixed essentially transversely to the axis of the handle. At least one spring body is provided, which causes the strips to spread apart, at least in the region of the holding device.

14 Claims, 3 Drawing Sheets

MOP

FIELD OF THE INVENTION

The present invention relates to a mop fastened to a mop handle, including a holding device to which a number of relatively mobile, absorbent strips made of a textile material are fixed essentially transversely to the axis of the handle.

BACKGROUND OF THE INVENTION

A mop of this type is described in German registered utility model 76 25 260. The absorbent strips, which are fixed in the holding device essentially transversely to the longitudinal direction of the handle, are normally made of a formed cotton fabric. They have essentially no elasticity, particularly in the wet state, and hang down in a freely pendulous way similar to yarn strands. Because of the lack of fullness of the formed cotton fabric from which they are made, the resulting appearance seems meager. In addition, due to the swinging motion during the course of cleaning floors, there is a latent danger of contact between the plastic holding device and furniture or walls which can lead to mutual damage and is not very satisfactory.

SUMMARY OF THE INVENTION

The object of the present invention is to further develop a mop of the type set forth above such a way that, while avoiding any substantial additional costs in manufacturing, achieves a fuller appearance in the wet state, along with a reduction of the danger of damage to the holding device and/or furniture as a result of any unintentional striking contacts.

This object is achieved in a mop made up of a number of relatively mobile, absorbent strips of textile that are affixed essentially transversely to the axis of the mop handle. The mop according to the present invention has at least one spring body which causes the strips to spread apart, at least in the region of the holding device. This gives the mop a fuller appearance, even when the strips are in the wet state, making it more attractive. In addition, the strips are prevented by the spring body from hanging down in a pendulous fashion parallel to the axis of the handle. As a result, they project beyond the holding device in the lateral direction, even in the wet state, so that a striking contact of a solid surface to the side compresses the strips between the surface and the holding device. This has the effect of absorbing the impact, and prevents damage from occurring to both sides in the event of contact with inflexible objects.

The spring body can be provided in the form of a foam body made of polymer material, polyurethane foam, for example, which, supports the strips while resting loosely against them in at least a partial region. The spring body may also be provided with a coating of an abrasive grit. Additionally, the spring body may be of viscose. It is expedient for the spring body to be fastened either directly or indirectly to the holding device and arranged so as to provided inner bracing of at least part of the strips.

It has proven to be especially useful for the dimensional design of the spring body to be such that it overlaps the holding device in the lateral direction. Although it is not easily detectable from the outside, a spring body configured in such a way acts on the strips in an elastically supporting fashion, which contributes considerably to preventing damage when the mop contacts an inflexible object during a swinging movement to the side.

In a mop design where the holding device and the strips are allocated to the imaginary extension of the handle in an essentially symmetrical distribution, it has proven to be beneficial for the spring body to be configured substantially symmetrically to the distribution. Circular holding device designs call for a circular design of the spring body, as well. However, it is within the scope of the present invention to give the holding device a regular polygon-shaped perimeter. The spring body would then have to be configured accordingly, and allocated to the holding device while avoiding a relative twisting.

It is also possible to use a spring body in the form of an elastic band that is laminated onto at least one side of the strips in at least a partial region. In doing this, it is also not strictly necessary to back all of the strips with corresponding elastic bands. Rather, in individual cases, it can suffice to configure in this way only the mop strips which lie on top. In the usual way, strips of that type are provided with a centrally placed opening, threaded onto one pin of the holding device, and distributed uniformly in the circumferential direction. The strips lying on top are clearly defined in this respect.

To avoid any impairment of the cleaning action, it has proven to be beneficial for the band to be provided only in the handle region, and for the holding device to overlap in the lateral direction. This enables those strip components which are decisive for achieving a good cleaning action and, in particular, their protruding ends to penetrate further into fine surface irregularities, which is important in terms of achieving good cleaning action.

Generally, the band can be made of a foil and/or a rubber band. On the other hand, it has proven to be advantageous for it to be made primarily of synthetic fibers joined together at their surfaces. Because of the resulting breathing activity, the drying process following prior wetting is improved with such an implementation, and thus decay is avoided, improving the service life of the mop. The band exhibits particularly good durability when the synthetic fibers which form it are joined to each other at localized, separate places via mutual fusion. When this is done, an especially attractive appearance results if the fibers are made at least in part of split fibers. In addition to a velvety surface appearance attained with such an implementation, one also achieves good elasticity, along with good spring elasticity, with associated good abrasion resistance. Nevertheless, comparatively low areal weight is sufficient to bring about the desired increase in the elasticity of the strips.

The band can be joined to the strips by bilateral sewing. In that respect, it has proven to be useful, both from a standpoint of production engineering, as well as hygiene, for the band to be joined to the strips at localized, separate places using a fusion-type adhesive. By way of example, polyethylene powder can be used as the fusion-type adhesive, whose adhesive particles, once applied, are spaced apart by a minimum spacing of about 2 mm. They are scarcely detectable following bonding.

BRIEF DESCRIPTION OF THE DRAWINGS

The invention shall be described in greater detail in the following, with reference to the following figures, in which.

DETAILED DESCRIPTION

Figure 1:
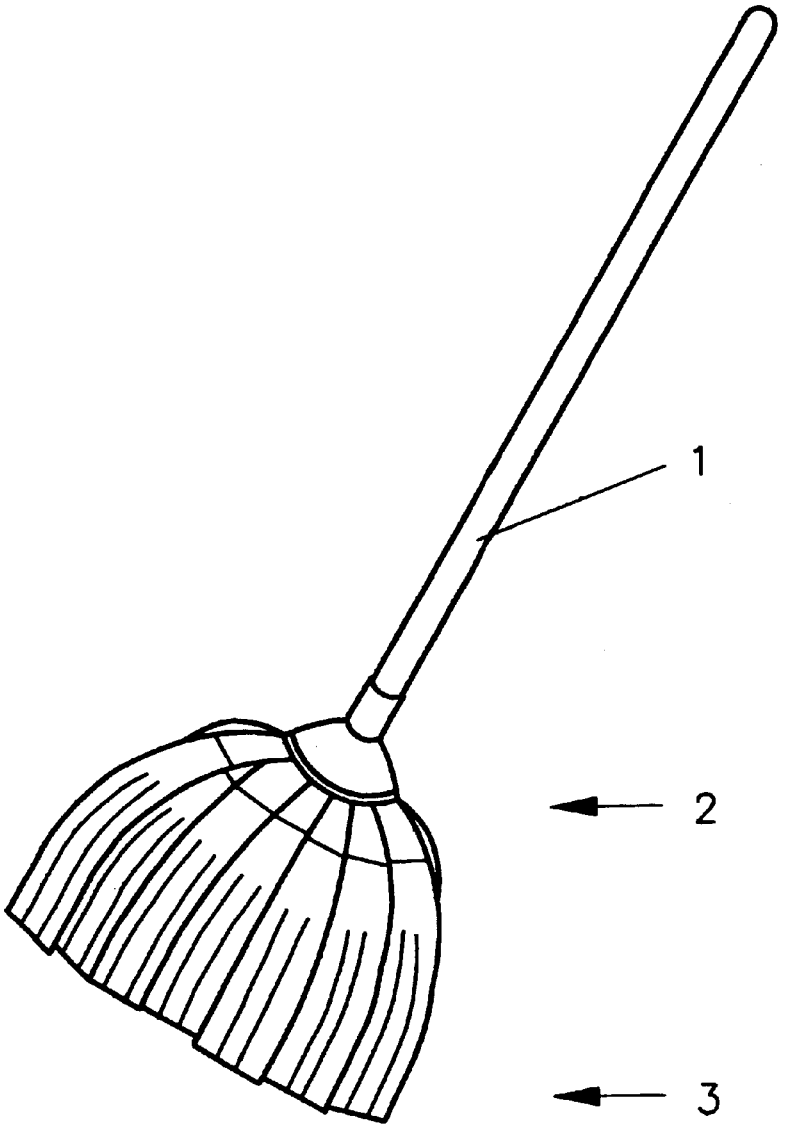
FIG. 1 is a perspective view of a mop constructed according to the principles of the invention, as viewed generally from above.
Figure 2:
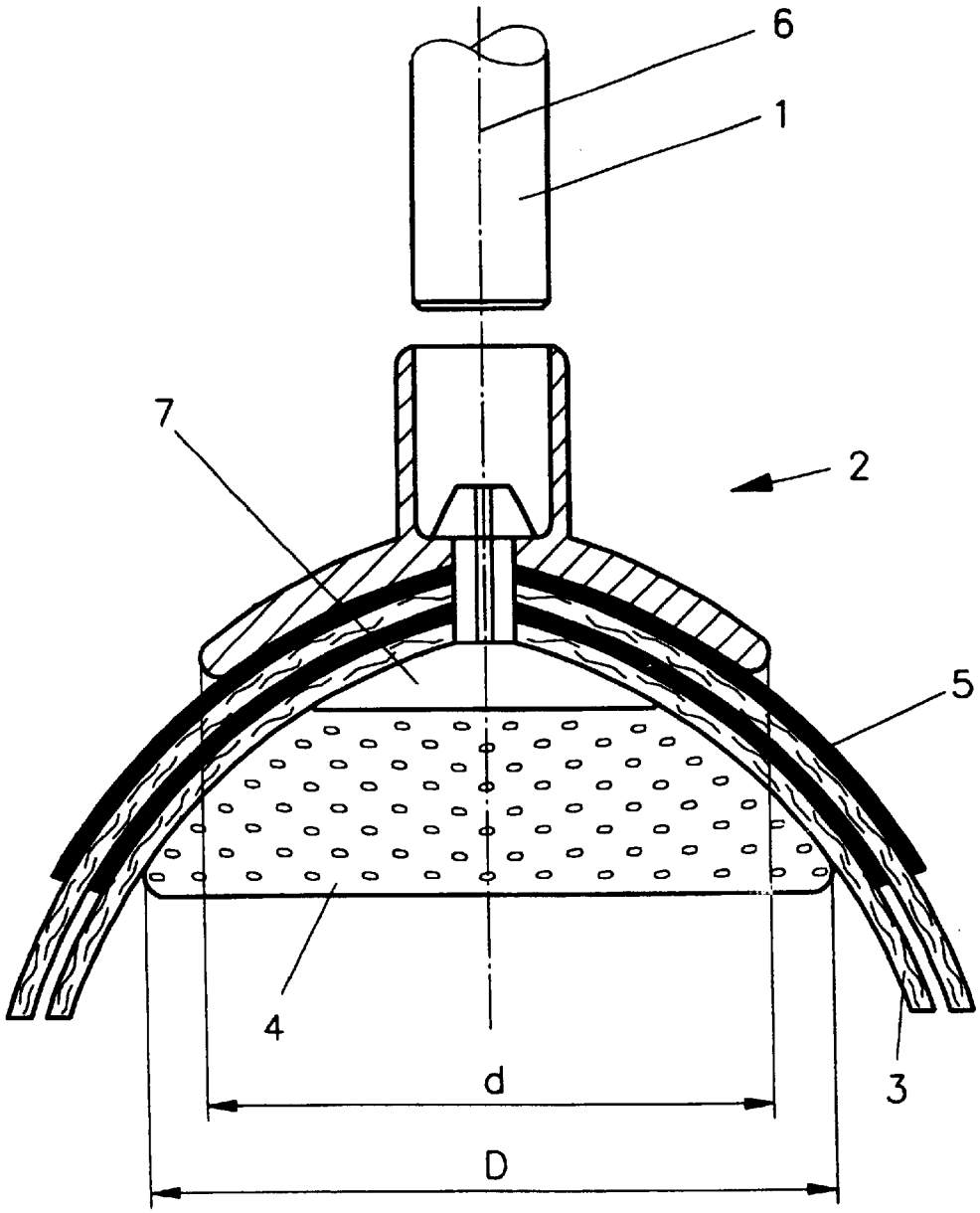
FIG. 2 is a cross-sectional view of the region of the holding device for the mop shown in FIG. 1.

The mop shown in FIGS. 1 and 2 is used, in particular, for the damp cleaning of floors. It is intended for mounting on a mop handle 1, and includes a holding device 2 to which a simple, relatively mobile absorbent strip 3 made of a textile material is affixed essentially transversely to axis 6 of handle 1. The textile material can be a formed cotton fabric having a mass per unit area of 100 to 300 g/m$^2$, preferably with a mass per unit area of 180 to 220 g/m$^2$, and which, if necessary, can be provided with an overprint in the top side region to improve abrasion resistance. The overprint can, for example, be made of a foamed latex, and contain components of a mark and/or graphic symbols. It is expedient for the overprint to be configured in such a way that it causes no significant stiffening of the cotton material.

Figure 3:
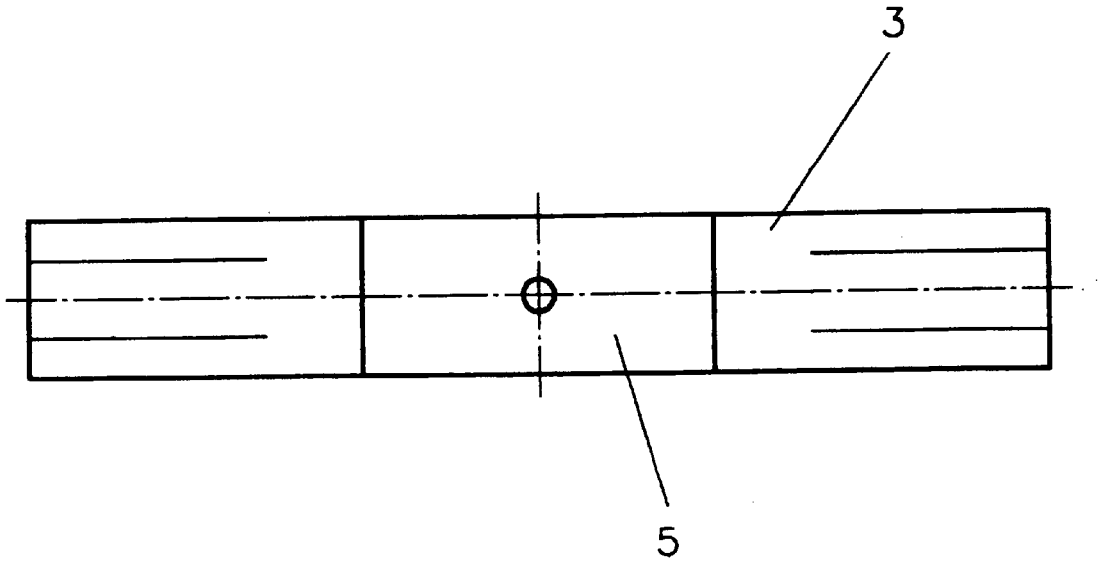
FIG. 3 is a plan view of an exemplary strip for use in a mop of the type shown in FIGS. 1 and 2.

Strips 3 shown in a top view in FIG. 3, are laminated on the top side in the middle region with a formed fabric made of split fibers having a mass per unit area of 40 to 100 g/m$^2$, expediently with a mass per unit area of 60 to 80 g/m$^2$.

Split fibers of this type are processed in the form of staple fibers. In the course of a carding process, they are joined at the surface and then subjected to spot welding to gradually fuse together the fibers forming the formed fabric. The product obtained is subsequently treated by very fine water jets, directed under a high pressure at its surface, causing the microfibers forming the split fibers to become loosened from one another between the conglutination points, thereby lending the product a full appearance and a fabric-like structure. Good elasticity is nonetheless present.

Bands are subsequently cut from the product obtained in this way and are bonded to the cotton strip 3, as shown in FIG. 3. To do this, a powdered fusion-type adhesive is applied to the intermediate zone between strip 3 and band 5, and the laminate obtained is exposed to the effect of pressure and heat, by ironing, for example, until a softening and conglutination of the two layers results. This conglutination achieves high strength during the subsequent cooling. It has both textile-like softness and good spring elasticity, in so far as the conglutination zones are separate from each other in locations, and the water permeability of the laminate is not significantly impaired.

The strips are inserted into the holding device, as shown in FIGS. 1 and 2, and are anchored by a mushroom head 7. The latter is made of plastic, and is joined on the underside to a spring body 4 made of a polyurethane foam and which, in the same way as holding device 2, has a rotationally symmetric shape, but with a diameter D which overlaps diameter d of holding device 2 in the lateral direction. As a result, impact is attenuated when unyielding objects are struck laterally. This rules out to the greatest extent possible any damage to holding device 2.

It can also be seen in FIG. 2 that an effect of this kind also is provided by bands 5, which overlap holding device 2 in the lateral direction and are conglutinated with strips 3 in the region of handle 1. If necessary, they can also entirely replace spring body 4, be used as a supplement to it, or be replaced by spring body 4.

What is claimed is:

1. A mop to be fastened to the end of a mop handle which defines a handle axis, comprising:

a plurality of relatively mobile, absorbent textile strips;

a holding device to which the textile strips are affixed essentially transversely with respect to the axis of the handle; and at least one spring body for spreading apart the strips in at least the area of the holding device, wherein the holding device, spring body and the strips are generally symmetrically arrayed about the axis of the handle and the spring body comprises an elastic band that comprises split fibers.

2. The mop according to claim 1, further comprising:

a spring body in the shape of a foamed body made of a polymer material, which supports the strips at least in a partial region, while resting loosely against them.

3. The mop according to claim 2, wherein the foamed spring body is fastened to the holding device and supports the strips interiorly.

4. The mop according to claim 2, wherein the foamed spring body is made of polyurethane foam or viscose.

5. The mop according to claim 2, wherein the foamed spring body is coated with an abrasive grit, at least at the surface.

6. The mop according to claim 1, wherein the spring body laterally overlaps the holding device.

7. A mop to be fastened to the end of a mop handle which defines a handle axis, comprising:

a plurality of relatively mobile, absorbent textile strips;

a holding device to which the textile strips are affixed essentially transversely with respect to the axis of the handle; and at least one spring body for spreading apart the strips in at least the area of the holding device, wherein the spring body comprises an elastic band which is laminated onto at least one side of the strips in at least a partial region.

8. The mop according to claim 7, wherein the band is provided only in the region of the handle and laterally overlaps the holding device.

9. The mop according to claim 7, wherein the band is made primarily of synthetic fibers which are joined at their surfaces.

10. The mop according to claim 9, wherein the fibers are joined to each other at localized, separate places by mutual fusion.

11. The mop according to claim 9, wherein the fibers of the band are made at least partially from split fibers.

12. The mop according to claim 7, wherein the band is joined to the strips at localized, separate places using a fusion-type adhesive.

13. A mop to be fastened to the end of a mop handle which defines a handle axis, comprising:

a plurality of relatively mobile, absorbent textile strips;

a holding device to which the textile strips are affixed essentially transversely with respect to the axis of the handle; and at least one spring body for spreading apart the strips in at least the area of the holding device, wherein the spring body is coated with an abrasive grit, at least at the surface.

14. The mop according to claim 13, wherein the spring body is made of polyurethane foam or viscose.

* * * * *